US005920602A

United States Patent [19]

Botzem et al.

[11] Patent Number: 5,920,602

[45] Date of Patent: Jul. 6, 1999

[54] UNDERGROUND STORAGE FACILITY, AND ASSOCIATED METHOD OF STORING WASTE

[75] Inventors: Werner Botzem, Alzenau; Harry Spilker, Bad Münder, both of Germany

[73] Assignee: Nukem GmbH, Alzenau, Germany

[21] Appl. No.: 09/000,208

[22] PCT Filed: Aug. 7, 1996

[86] PCT No.: PCT/EP96/03497

§ 371 Date: Feb. 4, 1998

§ 102(e) Date: Feb. 4, 1998

[87] PCT Pub. No.: WO97/06536

PCT Pub. Date: Feb. 20, 1997

[30] Foreign Application Priority Data

Aug. 9, 1995 [DE] Germany ..... 195 29 357

[51] Int. Cl.[6] ..... G21C 19/00; G21F 9/00

[52] U.S. Cl. ..... 376/272; 376/273; 376/274; 405/128; 588/16

[58] Field of Search ..... 376/272–274, 376/260, 261; 405/128, 129; 52/169.6; 588/1, 16, 17; 250/506.1, 507.1

[56] References Cited

U.S. PATENT DOCUMENTS 4,253,030 2/1981 Held et al. ..... 250/506.1

FOREIGN PATENT DOCUMENTS 0093671 11/1983 European Pat. Off. .
0390378 10/1990 European Pat. Off. .
2660217 10/1991 France .
2157061 10/1985 United Kingdom .
83/04455 12/1983 WIPO .

*Primary Examiner*—Charles T. Jordan
*Assistant Examiner*—Matthew J Lattig
*Attorney, Agent, or Firm*—Dennison, Meserole, Scheiner & Schultz

[57] ABSTRACT

The invention concerns an underground storage facility for the initial storage of waste transported in containers (34, 36), in particular radioactive waste such as spent fuel elements. The store has transport galleries (10) giving access to storage galleries (12) for storage of the waste. In order to ensure, among other things, safe storage and ease of introduction and transfer of the waste, the invention proposes that the storage gallery (12) runs underneath the transport gallery (10) and is separated from it by a floor (14), designed for the transport of the waste, with closable openings (18) for the introduction and removal of the waste.

14 Claims, 5 Drawing Sheets

UNDERGROUND STORAGE FACILITY, AND ASSOCIATED METHOD OF STORING WASTE

Figure 1:
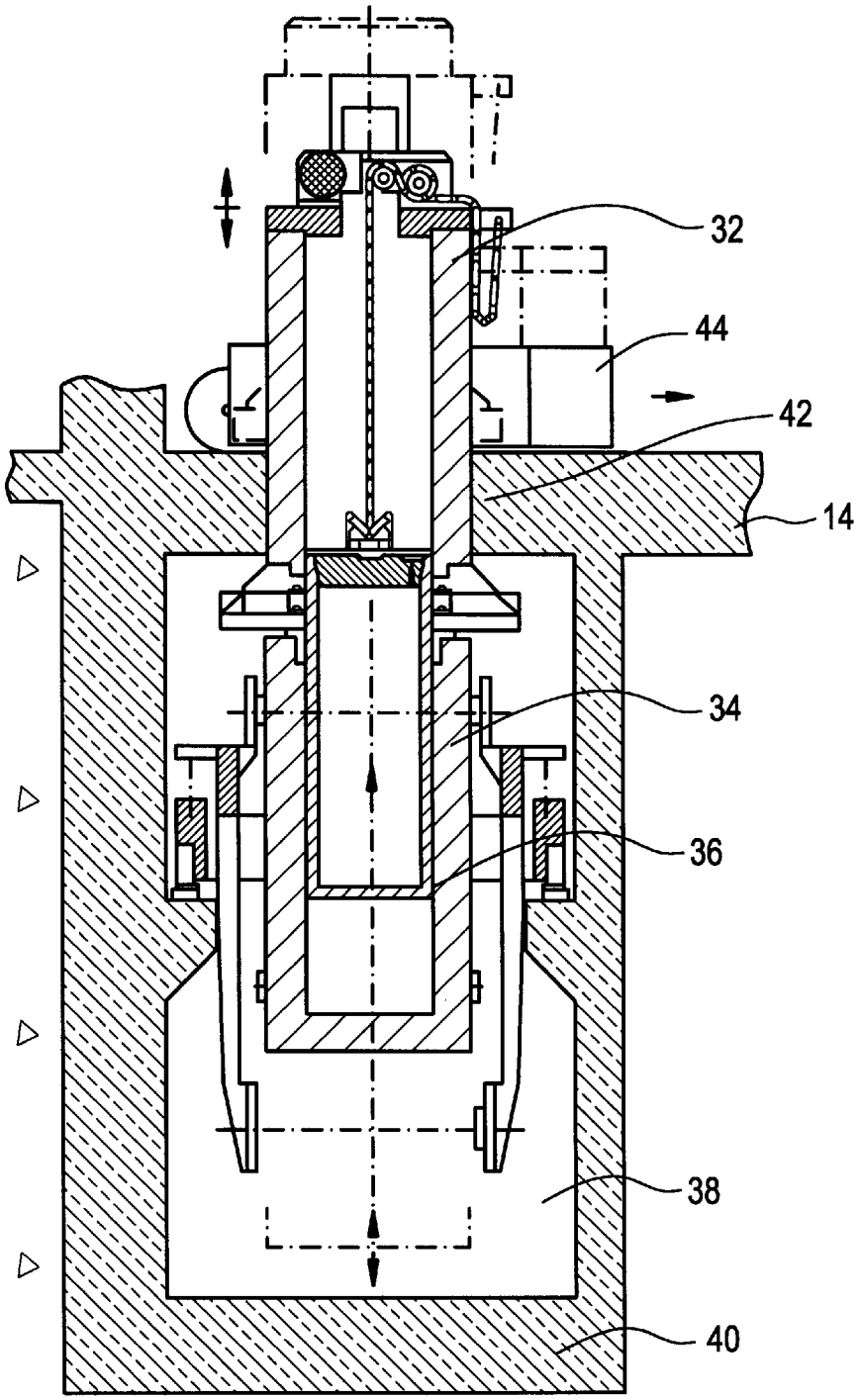

The invention relates to an underground storage facility for the interim storage of waste transportable in a container, in particular radioactive waste such as spent fuel elements, with transport gallery diving access to a storage gallery for interim storage of the waste. The invention further relates to a method for interim storage of waste, in particular of spent fuel elements, in an underground storage facility with transport gallery giving access to a storage gallery, the waste being transported to the storage facility in an inner container of a transport container.

Before radioactive waste such as spent fuel elements reach a final storage facility, they are frequently kept for many years in an interim storage facility. The latter is in particular an underground storage facility located inside a mountain. In the known storage facilities, storage galleries lead off from a transport gallery and the waste is deposited inside these in transport containers. Since these transport containers are very expensive, considerable financial resources are bound up in a storage facility. The dimensions of the transport containers mean that the storage galleries have to be designed fairly wide. This has the drawback that cooling air cannot flow through the storage galleries by connection at the required rate, and instead it is necessary to install special equipment in order to achieve the necessary control of the flow. Since the transport containers are arranged one behind the other inside a storage gallery, it is rather difficult to transfer the transport containers or to remove a transport container located at the front of a storage gallery, since in this case the containers at the front (when viewed from the transport gallery) have to be removed first of all.

An underground storage facility for spent nuclear reactor fuel elements is known from DE 33 40 101 A1.The storage areas are inside a cavern area of elliptical cross-section. Inside this storage area the fuel elements are arranged in individual horizontal storage pipes. Cooling air lows vertically upwards through the storage area. The lower part of the cavern area of elliptical cross-section is used for air supply, and the upper part for air removal. Individual pipes branch off from the main air supply and removal pipes in order to supply the individual storage areas with cooling air.

DE 39 4 65C1 describes a storage facility in which radioactive wastes are deposited in a borehole. Corresponding proposals to solve the problem can be found in WO 88/08608, EP 0 093 671B1 and DE 28 39 759A1.

According to DE 24 33 168B2, caverns extend from a transverse gallery designated as the transport gallery and are used for the storage of radioactive wastes. To transport or transfer radioactive materials, loading machinery or shielding bells are known from DE 32 48 592C2 and DE 40 34 710A1.

The problem underlying the present invention is to develop an underground storage facility and a method for interim storage of waste of the type mentioned at the outset such that inexpensive yet safe interim storage is possible, where a simple introduction or rapid transfer has to be possible. Cooling of the waste by convection should also be possible without any problem.

The problem is solved in accordance with the invention by an underground storage facility characterized mainly in that the storage gallery runs underneath the transport gallery and is separated from the latter by a floor designed as a transport level having closable openings intended for introduction and removal of the waste. The openings are closed with locking covers having a shielding function and separating the storage gallery from the transport gallery in respect of the effects of radiation. The storage gallery has an approximately rectangular cross-section and the transport gallery an approximately semi-elliptical or semi-oval cross-section, with the width of the storage gallery being less than that of the transport gallery. Cooling of the containers containing radioactive materials and stored in the storage gallery, such as fuel element containers, is achieved by passing cooling air through the storage gallery of rectangular cross-section running underneath the floor of the transport gallery. Accordingly, cooling is achieved by a horizontally directed air flow around the stored containers.

It is of course also possible for at least one storage gallery to lead off from the side of the transport gallery.

Unlike in the prior art, the storage gallery and the transport gallery are arranged one above the other, allowing easy introduction or removal and hence transfer of waste via the floor openings in the transport gallery. The floor itself is preferably of concrete here, with the openings being closable with cylindrical closing covers also made of concrete.

To keep rock thrusts well away from the storage gallery/galleries, a further development of the invention provides for the width of the storage gallery of preferably rectangular cross-section to be less than that of the transport gallery of approximately semi-elliptical or semi-oval cross-section.

Since the storage gallery is shielded from the transport gallery, it is only necessary for the waste to be stored in an inner container, and no longer in the transport container itself once inside the storage gallery. This has the advantage that the transport container can be reused immediately after removal of the inner container. Furthermore, the width of the storage gallery compared with those in which transport containers are stored can be designed more narrow. This allows the possibility of designing the storage gallery itself as a section of the convection air duct without additional construction measures, with the storage gallery having at its end filtering devices in order to keep microorganisms or dust, for example, out of the storage area.

Vertical ventilation ducts lead off from the storage gallery itself, so that a strong updraught results from the heated air. The air is heated here by the heat-generating waste such as spent fuel elements or other highly active waste.

The fact that the inner containers are introduced into the storage gallery via the opening in the transport gallery means that the inner containers can be transferred inside the storage gallery in a simple manner, allowing new waste for storage to be positioned initially in the air flow that is not yet heated, hence ensuring optimum cooling possibilities and minimum waste temperatures.

Cooling in accordance with the invention is achieved by the air flow passing horizontally through the storage gallery. Since the storage gallery is loaded from above, it can be designed fairly narrow, i.e. only slightly wider than the diameter of a container to be stored. This has in particular the advantage that favorable air flows result, leading to good cooling of the waste. If necessary, the storage gallery can have filtering equipment at the end.

In a further noteworthy embodiment of the invention, it is provided that the waste present in an inner container is surrounded inside the transport gallery by a conveying container closing at the bottom, using which the inner container can be deposited into the storage gallery through one of the floor openings of the transport gallery. The conveying container here can have a lifting/lowering or holding device for the inner container only its inside.

The covers closing the floor opening are themselves lifted/lowered by a transport carriage movable alone the floor and controllable independently of the conveying container.

A method for interim storage of waste, in particular of spent fuel elements, in an underground storage facility faith transport gallery giving access to a storage gallery, where the waste is transported to the storage facility inside an inner container of a transport container, is characterized in that the inner container containing the waste is picked up in the facility or in its immediate vicinity by a movable conveying container on its floor side that moves inside the transport gallery along a floor closing the storage gallery at the top, in that after introduction of the inner container into the conveying container the latter is closed on the floor side and moved to an opening closed by a lid in the floor of the transport gallery, and in that the cover is removed, the conveying container then aligned with the opening and its floor opened, and the inner container is passed by conveying elements provided in the conveying container through the opening and into the storage gallery, then the opening is closed and the conveying container is moved to a transport container to pick up an inner container or to a further opening in the transport gallery floor to remove or transfer the inner container placed in the storage gallery.

Independently of this, it is possible for the inner container to be provided with corrosion protection after removal from the storage facility so that it can then be transported to a final storage facility.

Finally, it is possible once the afterheat has receded sufficiently to fill the storage gallery with bentonite, for example, so that the interim storage facility is converted into a final storage facility.

Further details, advantages and features of the invention are shown not only in the claims and in the features they contain—singly and/or in combination—but also in the following description of a preferred design example shown in the drawing.

The drawings shows in

Figure 2:
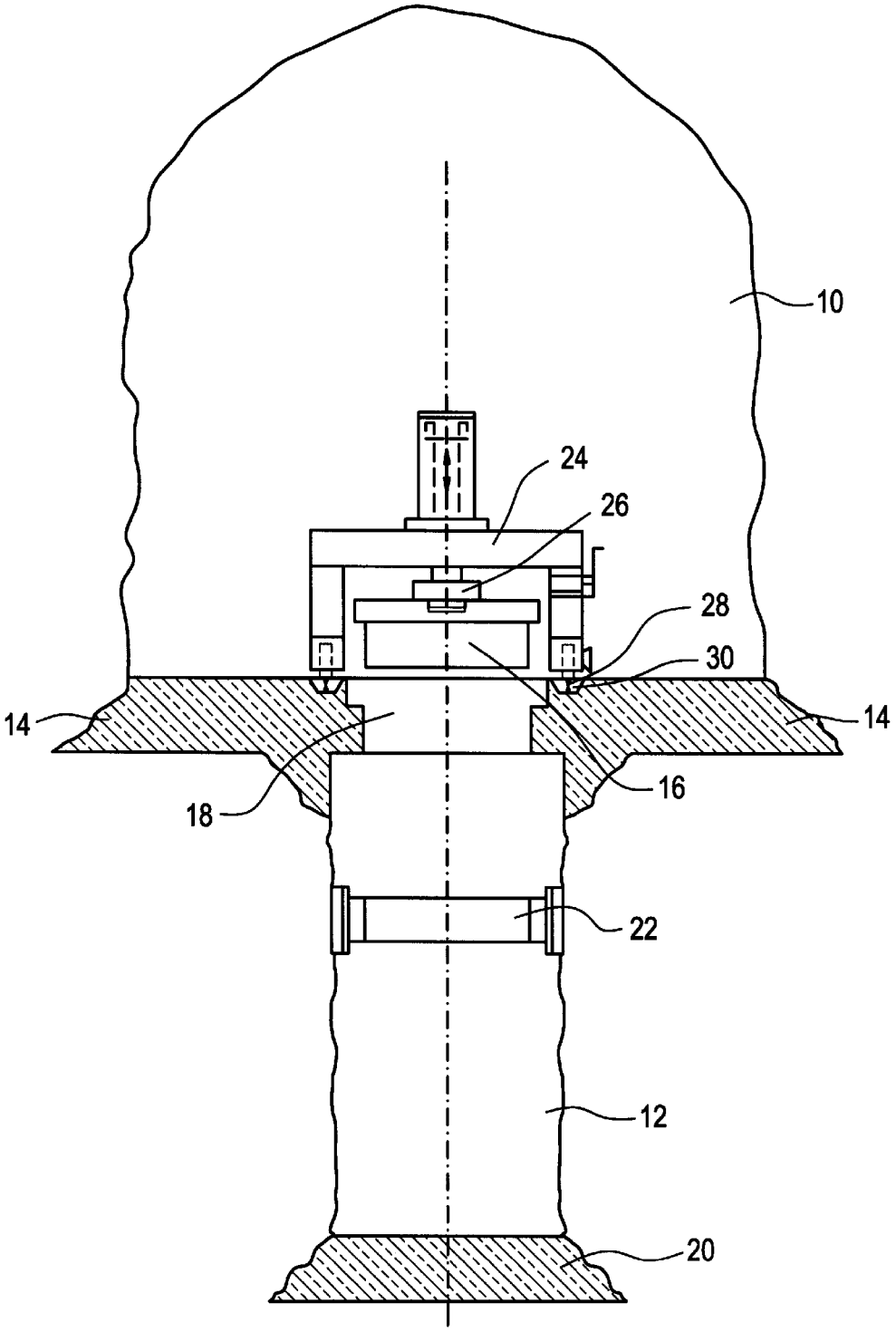
Figure 3:
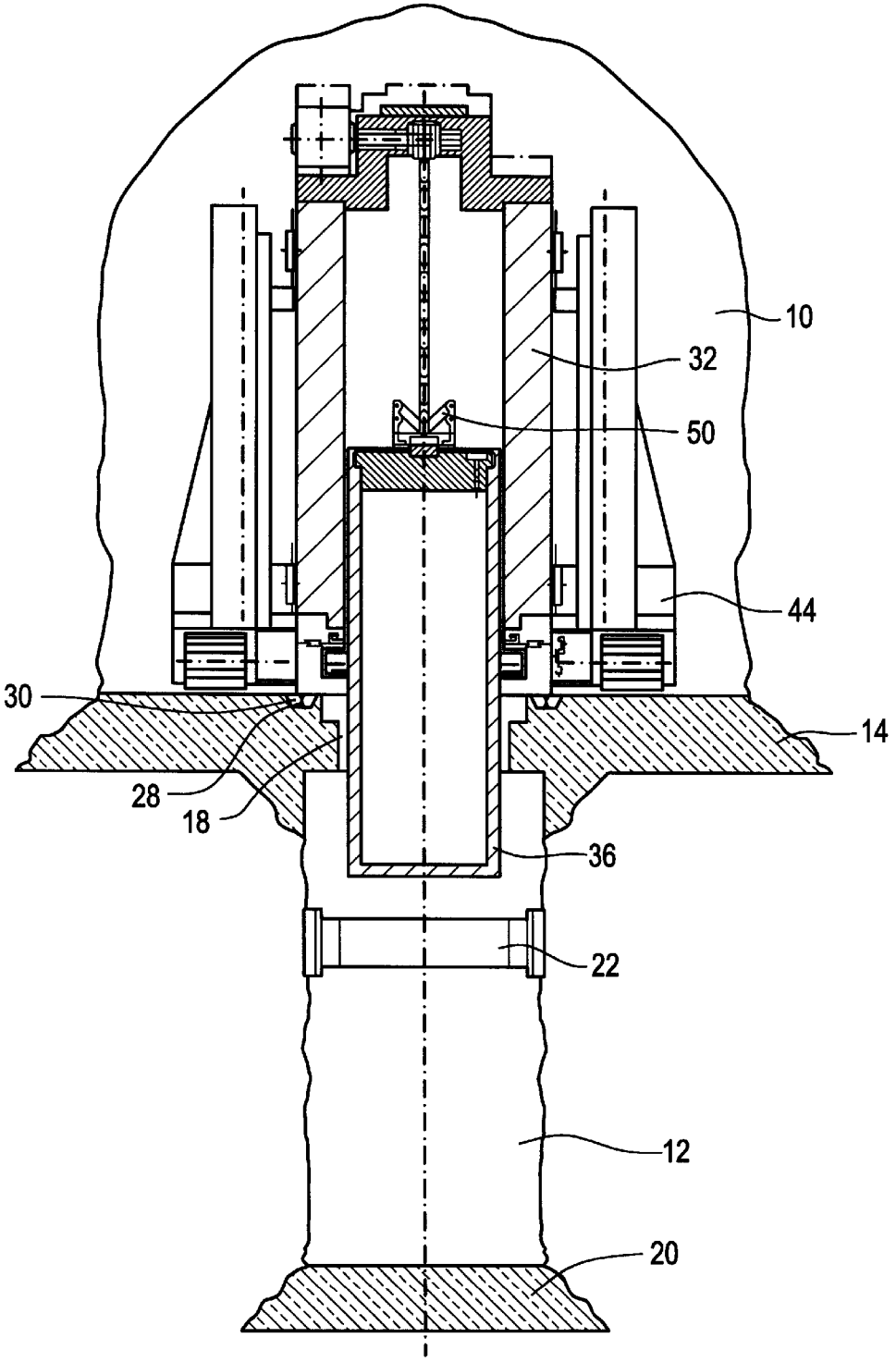
Figure 4:
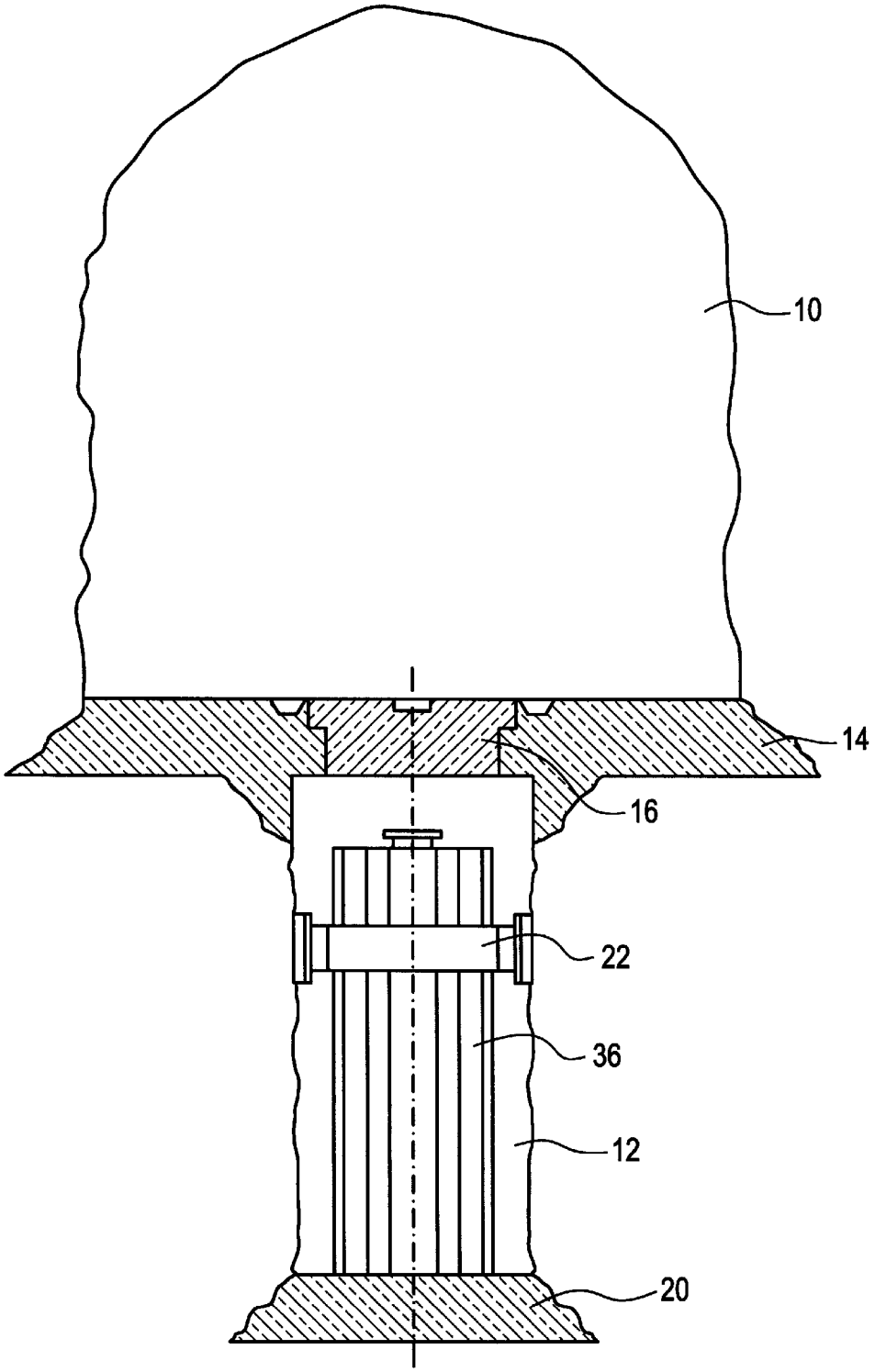
Figure 5:
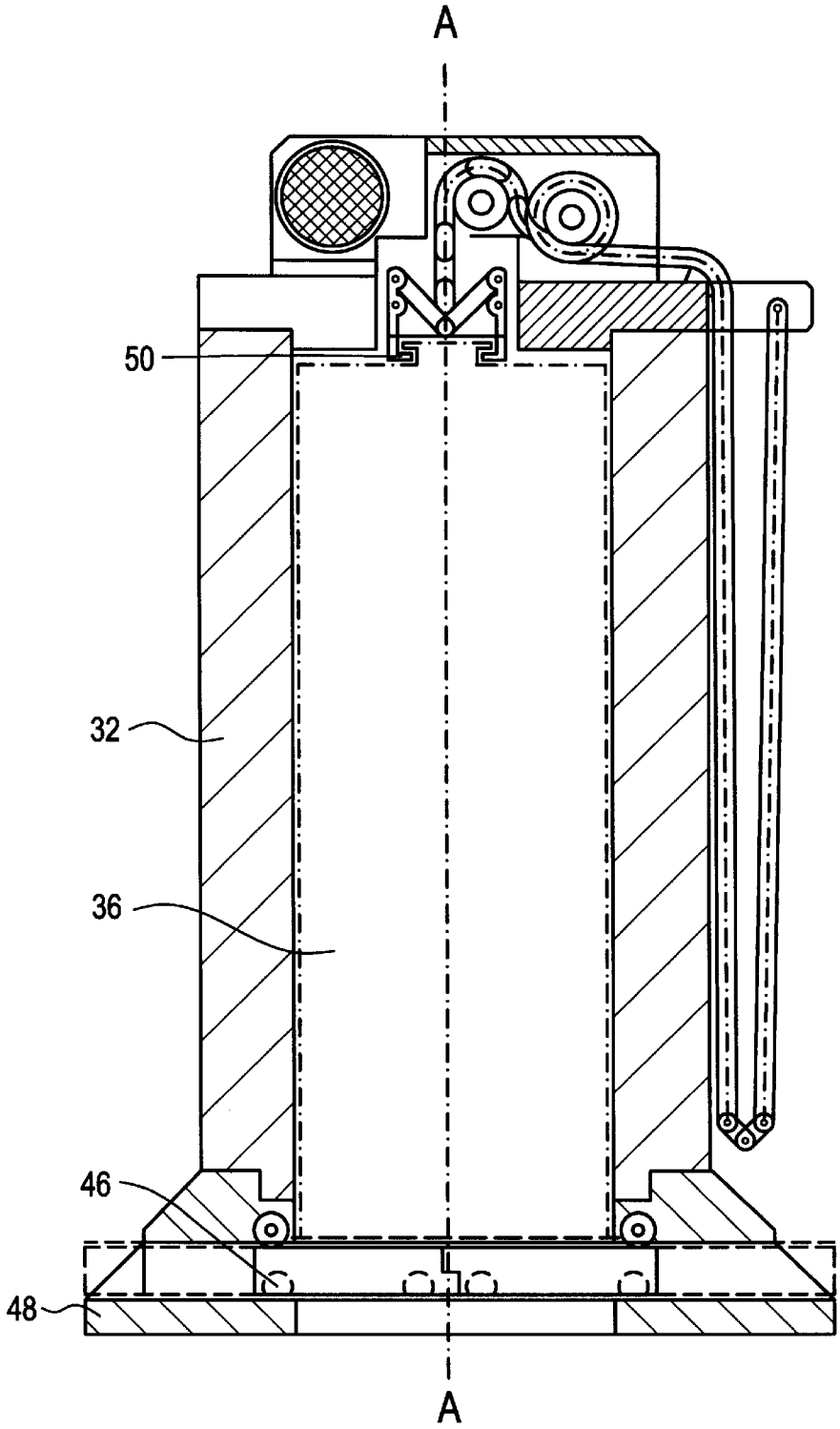

FIG. 1 an area of a storage facility for receiving a waste-containing inner container of a transport container, FIG. 2 a section of a storage facility in cross-section with transport gallery and storage gallery, FIG. 3 the transport gallery and storage gallery according to FIG. 2 during introduction of an inner container into the storage gallery, FIG. 4 the transport gallery and storage gallery according to FIG. 2 with inner container placed in the storage gallery, and FIG. 5 a diagram showing the principle of a conveying container shown in FIGS. 1 and 3.

The figures show sections of a storage facility for radioactive waste formed in a mountain, particularly heat-generating waste, such as spent fuel elements. The storage facility comprises a transport gallery 10, beneath which runs a storage gallery 12.

The transport gallery 10 having in cross-section the geometry of a semi-ellipse or semi-oval has a concrete floor 14 on the one hand covering the storage gallery 12 of rectangular section and on the other hand having openings 18 closable via covers 16 and giving access to the storage gallery 12, in order to introduce or remove radioactive waste in the manner described in the following. The storage gallery 12 itself has a concrete floor 20 and is protected against earthquakes by side struts 22.

The opening is are also closable by concrete covers 16. To ensure safe fitting of the cover 6 into the opening 18 and to shield it from the storage gallery 12, the cover 16 has all all-round flange, not however shown in detail, that can be set down on a step of the opening 18, also not shown in detail.

As FIGS. 2 to 4 make clear, the lateral extent of the transport gallery 10 is greater than that of the storage gallery 12. The width of the transport gallery 10 is preferably two to three times that of the storage gallery 12. The advantage of this is that rock thrusts are diverted well away, thereby creating a long-term and strong cavern as the storage gallery 12 that requires no further expansion.

To remove the cover 16 from an opening 18 or to close it, a movable carriage 24 with a holding device 26 for the cover 16 is provided. The carriage 24 moves on rails 28, 30 that are arranged on both sides of the openings 18 arranged in a row along the transport gallery 10.

A conveying container 32 is also movable on the rails 28 and 30 in order to pick up waste for interim storage from a transport container 34, move it inside the transport gallery 10 and then set it down in the storage gallery 12 via one of the openings 18, and vice versa.

The waste itself is in an inner container 36 of the transport container 34, which can have a conventional design, i.e. closable with a single or double cover, for example, which is howsoever not shown in FIG. 1. In order to remove the inner container 36 together with the waste from the transport container 34, the latter is initially moved into a cell 38 which is shielded over its circumference by concrete walls 40. On the top the cell 38 has an opening 42 which can be traversed by the converting container 32 in order to pick up the inner container 36. To that end, the conveying container 32 is picked up by a conveying carriage 44 such as a caterpillar unit in order on the one hand to be raised/lowered and on the other hand to be moved along the floor 14. The conveying container 32 is closable at the bottom by means of a plate 46 movable parallel to the floor 14 of the transport gallery 10 and extending from a frame 48 that is part of the conveying container 32 and that can be picked up by the conveying carriage 44.

Furthermore, a conveying unit 50 extends inside the conveying container 32 in order to remove the inner container from the transport container 34 and to place it inside the storage gallery 12 via one of the openings 18 and vice versa.

In order to place an inner container 36 with waste for interim storage inside the storage gallery 12, the caterpillar unit 44 and hence the conveying container 32 are first moved to a required opening 18 in the floor 14 of the transport gallery 10. Then the cover 16 is lifted using the carriage 24 and moved laterally to the opening 18, in order to permit alignment of the conveying container 32 with the opening 18 and lowering of the inner container 36, as is made clear in FIG. 3.

Once the inner container 36 has been set down on the floor 20 of the storage gallery 12 and the conveying container 32 has been moved clear of the opening 18, the latter is closed using the cover, as shown in FIG. 4. The cover 16 is designed as a shielding cover, so that the storage area is separated from the transport gallery 10 in respect of the effects of radiation. The conveying container 32 can then once again be moved to the cell 38 using the caterpillar unit 44 in order to pick up a further inner container. It is also possible to remove and transfer inner containers 36 from the storage gallery 12. The same measures are taken when the inner container 36 is to be removed from the interim storage facility and transferred to a final storage facility. It may only be necessary here to provide the inner container 36 with corrosion protection before it is placed in final storage.

The fact that only inner containers 36 are placed inside the storage gallery 12 and are accessible from above means that the storage gallery can be designed fairly narrow. One advantage of this is that favorable air flows result when ventilation ducts lead upwards out of the storage gallery 12 and have a good cooling effect on the waste. Furthermore, the storage gallery 12 can be sealed at the end by filtering devices.

The width of the transport gallery 10 should be about 2 to 3 times that of the storage gallery 12, in order to divert rock thrusts away from the storage gallery 12.

What is claimed is:

1. An underground storage facility for the interim storage of waste transportable in a container (34, 36), in particular radioactive waste such as spent fuel elements, with transport gallery (10) giving access to a storage gallery (12) for interim storage of the waste, wherein the storage gallery (12) runs underneath the transport gallery (10) and is separated from the latter by a floor (14) designed as a transport level having closable openings (18) intended for introduction and removal of the waste and closable with locking covers (16) separating the storage gallery from the transport gallery in respect of the effects of radiation, wherein the storage gallery has an approximately rectangular cross-section and the transport gallery an approximately semi-elliptical or semi-oval cross-section, and wherein the width of the storage gallery is less than that of the transport gallery.

2. A storage facility according to claim 1, wherein the floor of the transport gallery (10) is a floor made of concrete (14) whose openings (18) are closable with cylindrical closing covers (16) preferably made of concrete.

3. A storage facility according to claim 1, wherein the openings (18) in the floor (14) of the transport gallery (10) are arranged one behind the other in the longitudinal direction of the transport gallery and along which run guides such as rails (28, 30).

4. A storage facility according to claim 1, wherein the storage gallery (12) of approximately rectangular cross-section is supported at the sides by earthquake protection devices such as struts (22).

5. A storage facility according to claim 1, wherein the storage gallery (12) is a section of a convection air channel.

6. A storage facility according to claim 1, wherein the storage gallery (12) has at its end filtering devices.

7. A storage facility according to claim 1, wherein the waste is arranged in an inner container (36) of the container (34) having an opening closable at the top, wherein the inner container is provides stronger radioactive shielding at the closing side than at the circumference and bottom sides, and wherein the inner container is surrounded inside the transport gallery (10) by a conveying container (32) closing at the bottom and using which the inner container can be placed inside the storage gallery (12) through one of the floor openings (18) of the transport gallery.

8. A storage facility according to claim 1, wherein the conveying container (32) has a lifting/lowering or holding device (50) for the inner container (36) on the interior side.

9. A storage facility according claim 1, wherein the covers (16) closing the floor openings (18) can be lifted/lowered and transferred by a transport carriage (24) movable along the floor (14).

10. An underground storage facility for the interim storage of waste stored in an inner container (36) such as the inner container of a transport container (34), in particular radioactive waste such as spent fuel elements, with transport gallery (10) giving access to a storage gallery (12) for interim storage of the waste, wherein the storage gallery (12) runs underneath the transport gallery (10) and is separated from the latter by a concrete transport floor (14), wherein closable openings (18) are provided in the transport floor and have covers (16) separating the storage gallery from the transport gallery in respect of the effects of radiation and via which inner containers (36) containing the waste can be introduced, removed and/or transferred in the storage gallery, wherein the transport gallery has a semi-elliptical or semi-oval cross-section with a width less than that of the storage gallery of approximately rectangular cross-section, and wherein the inner container is picked up inside the transport gallery by a conveying container (32) closable at the bottom and having on the inside a conveying device (50) for the inner container.

11. A method for interim storage of waste, in particular of spent fuel elements, in an underground storage facility with transport gallery giving access to a storage gallery, the waste being transported to the storage facility in an inner container of a transport container, wherein the inner container containing the waste is picked up in the facility or in its immediate vicinity by a movable conveying container on its floor side that moves inside the transport gallery along a floor closing the storage gallery at the top, wherein after introduction of the inner container into the conveying container the latter is closed on the floor side and moved to an opening closed by a lid in the floor of the transport gallery, and wherein the cover is removed, the conveying container then aligned with the opening and its floor opened, and the inner container is passed by conveying elements provided in the conveying container through the opening and into the storage gallery, then the opening is closed and the conveying container is moved to a transport container to pick up an inner container or to a further opening in the transport gallery floor to remove or transfer the inner container placed in the storage gallery.

12. A method according to claim 11, wherein the inner container is provided with corrosion protection after removal from the storage facility and is transported to a final storage facility.

13. A method according to claim 11, wherein once the afterheat has receded the storage gallery is filled up in order to form a final storage facility.

14. A method according to claim 13, wherein the storage gallery is filled with bentonite.

* * * * *